US005960911A

United States Patent [19]

Guaita et al.

[11] Patent Number: 5,960,911

[45] Date of Patent: Oct. 5, 1999

[54] ELEVATOR SYSTEM HAVING GUIDE ROLLERS

[75] Inventors: Erminio Guaita, Cologno Monzese Mi; Luigi Angelo Sala, Milan, both of Italy

[73] Assignee: Otis Elevator Company, Farmington, Conn.

[21] Appl. No.: 08/986,594

[22] Filed: Dec. 8, 1997

[51] Int. Cl.[6] ..... B66B 7/04

[52] U.S. Cl. ..... 187/410; 187/406; 104/129

[58] Field of Search ..... 187/410, 406, 187/408; 104/127, 129, 249

[56] References Cited

U.S. PATENT DOCUMENTS

| | | | |
|---|---|---|---|
| 1,613,901 | 1/1927 | Parrish | 187/410 |
| 1,986,620 | 1/1935 | Borden et al. | 187/410 |
| 2,100,169 | 11/1937 | Norton | 187/406 |
| 2,309,123 | 1/1943 | Kiesling | 187/406 |
| 4,316,535 | 2/1982 | Brems et al. | 104/127 |
| 4,568,305 | 2/1986 | De Anda et al. | 104/249 |
| 4,817,533 | 4/1989 | Azukizawa et al. | 104/129 |

FOREIGN PATENT DOCUMENTS

| | | | |
|---|---|---|---|
| 290804 A1 | 11/1988 | European Pat. Off. | 187/410 |
| 52-55143 | 5/1977 | Japan | 187/410 |
| 3-288782 | 12/1991 | Japan | 187/410 |
| 5-70056 | 3/1993 | Japan | 187/406 |
| 451601 | 11/1974 | U.S.S.R. | 187/410 |

*Primary Examiner*—Christopher P. Ellis
*Assistant Examiner*—Thuy V. Tran

[57] ABSTRACT

An elevator system includes a guide roller having a contact surface and a flange that extends outward from the roller. A guide rail for the elevator system includes a cam that is disposed to engage the flange of the roller. During extended periods of non-use, the elevator car is positioned such that the flange engages the cam and the loading on the contact surface of the roller is minimized or eliminated.

22 Claims, 2 Drawing Sheets

ELEVATOR SYSTEM HAVING GUIDE ROLLERS

TECHNICAL FIELD

The present invention relates to elevator systems, and more particularly to such systems having guide rollers.

BACKGROUND OF THE INVENTION

A conventional elevator system includes an elevator car that travels through a hoistway. The travel path of the car is defined by a pair of guide rails that extend longitudinally through the hoistway. The car is engaged with the guide rails by guide rollers that roll along the guide surfaces of the rails.

In one type of such elevator system, the elevator car is mounted in a cantilevered arrangement in order to minimize the space requirements of the elevator system. In this type of mounting arrangement, the guide rollers include an upper pair of rollers and a lower pair of rollers. The upper rollers are located on the side of the guide rails opposite the elevator car and the lower rollers are located on the same side of the guide rails as the car. As a result, the guide rollers are exposed to reaction forces caused by the loading of the car.

A drawback to the cantilevered type arrangement is the deformation of the guide rollers caused by the reaction forces. One particular problem is that the rollers, which typically have a contact surface formed from an elastomeric material, become deformed during extended periods of non-use. When the car is parked for an extended period of time, the reaction forces are concentrated on the portion of the elastomeric material in contact with the guide rail. As a result, the elastomeric material deforms and a 'flat' area develops in the roller. During subsequent operation of the elevator system, the flat portion of the roller produces vibration that is perceptible by and discomforting to the passengers riding the elevator. This is a particularly significant problem for the lower rollers of the cantilevered cars.

The above art notwithstanding, scientists and engineers under the direction of Applicants' Assignee are working to develop methods and apparatus to improve and maintain the ride quality of elevator systems.

DISCLOSURE OF THE INVENTION

According to the present invention, a guide roller for an elevator system includes a contact surface and a flange. The flange extends outward from the roller and, upon sufficient motion of the elevator car, engages a cam disposed on the guide rail. Engagement of the flange and the cam minimizes the loads on the contact surface of the roller.

The primary advantage of the invention is the improved ride quality of the elevator system. This advantage results from the reduction or elimination in the deformation of the contact surface of the roller. The elevator car may be parked for extended periods of time with the flange engaged with the cam. Since the loads are removed from the contact surface, the elastomeric material of the roller does not deform and the 'flat' areas of the roller can be avoided.

In a particular embodiment, the elevator system includes a cantilevered car that moves within a hoistway and is engaged with a pair of guide rails that extend through the hoistway. The car includes two pair of guide rollers, an upper pair and a lower pair. Each of the lower pair of guide rollers includes a contact surface formed from an elastomeric material and a flange formed from a metallic material, such as steel, and that extends outward from the roller. The guide rollers engage the pair of guide rails and each guide rail includes a cam disposed to engage one of the lower rollers. The cams include an inclined surface and a level surface. The inclined surface initially engages the flange to gradually move the contact surface away from the guide rail. The cams are located at the lowest landing of the hoistway such that, with the car positioned at the lowest landing, the flanges of the lower pair of guide rollers are engaged with the cams.

Since the cams only contact the flanges when the car is stopping at the lowest landing, the speed of the car is always minimal and the interaction between the flanges and cams is smooth and gradual. Passengers will feel little, if any, vibration from the initial contact and movement of the rollers away from the guide rails.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
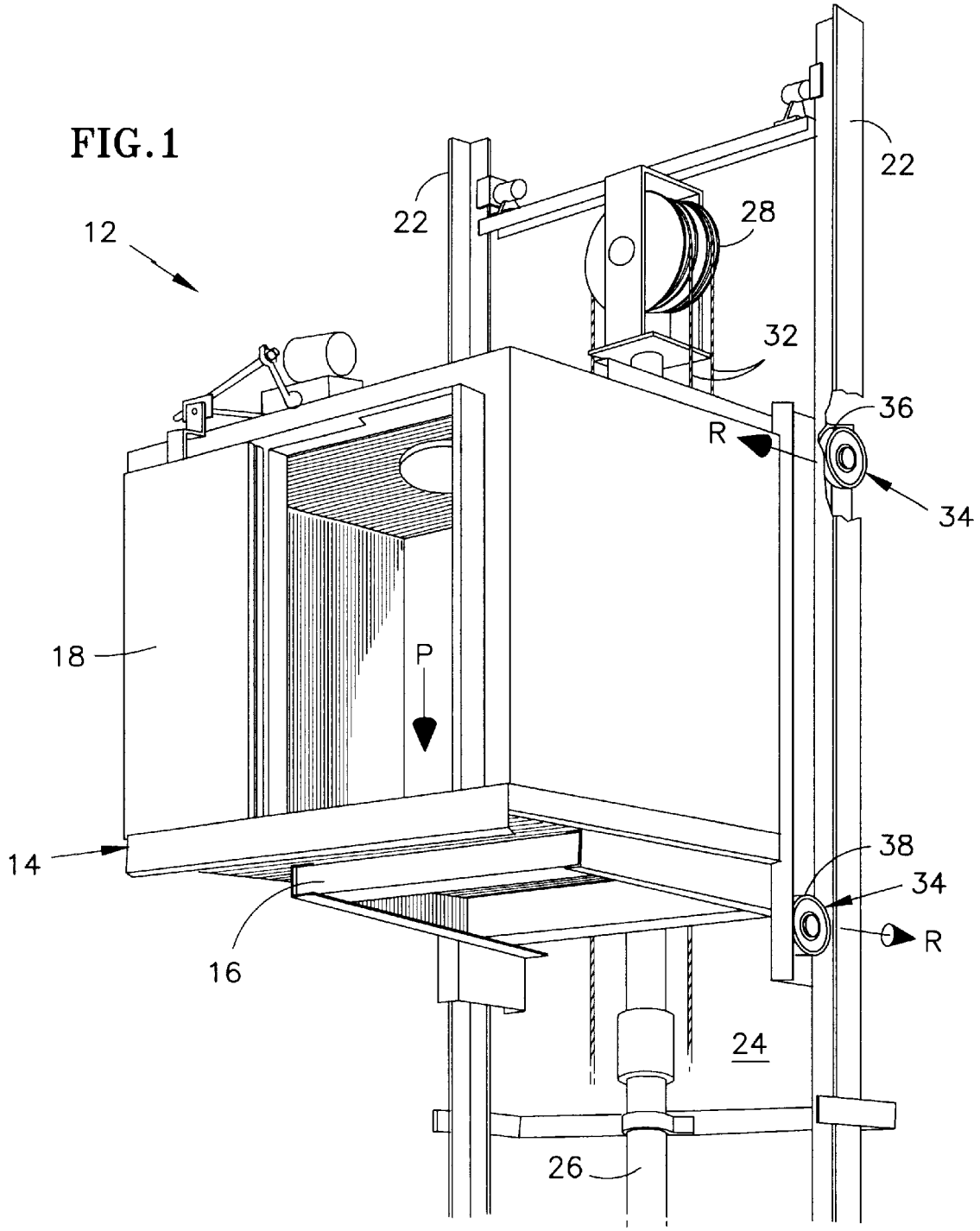
FIG. 1 is a perspective view of a cantilever mounted elevator system.

Illustrated in FIG. 1 is a hydraulic elevator system 12. The elevator system 12 includes a car 14 having a frame 16 and a cab 18, a pair of guide rails 22 that extend through a hoistway 24, a hydraulic cylinder 26 having a sheave 28, and a plurality of ropes 32. Each rope 32 has one end attached to the car frame 16 and the opposite end secured to a position in the hoistway 24. The car 14 is mounted in a conventional cantilevered type arrangement. The frame 16 includes two pair of guide rollers 34 engaged with the guide rails 22, an upper pair of rollers 36 and a lower pair of rollers 38. Each pair of rollers 36, 38 includes one roller on each side of the car 14 (only one of each pair of rollers 36, 38 is shown in FIG. 1). Actuation of the hydraulic cylinder 26 causes the sheave 28 to move. Movement of the sheave 28 moves the car 14 via the ropes 32.

One roller of each of the pairs of rollers 36, 38 is engaged with one of the guide rails 22. As a result of the cantilevered mounting arrangement, the load P of the car 14 produces a force R on each roller in the direction shown by arrows. The guide rails 22 produce a reaction force on the rollers 36, 38. Since the forces are in opposite directions on the upper rollers 36 and lower rollers 38, the upper rollers 36 and lower rollers 38 on each side of the car are engaged with opposite faces of the guide rail 22. During movement of the car 14 through the hoistway 24, the rollers 36, 38 are in constant contact with the guide rails 22 to guide the motion of the car 14.

Figure 2:
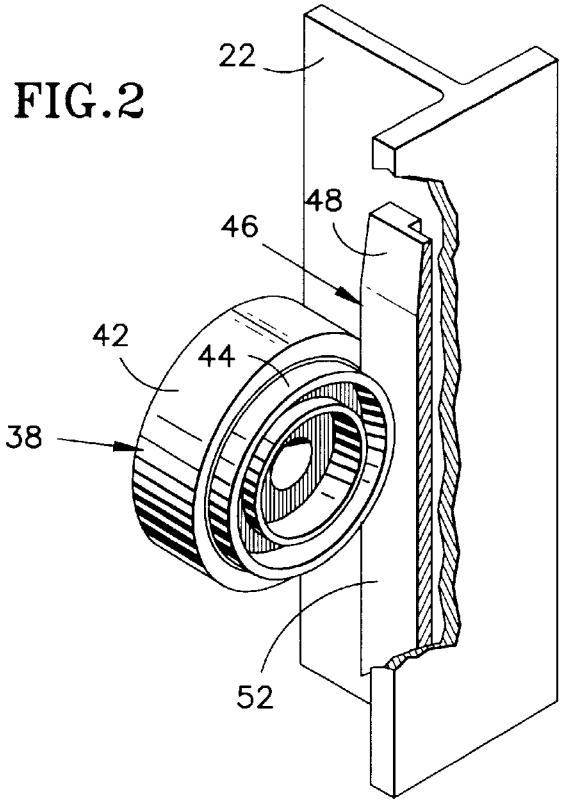
FIG. 2 is a perspective view of a guide roller engaged with a cam on a guide rail.
Figure 3:
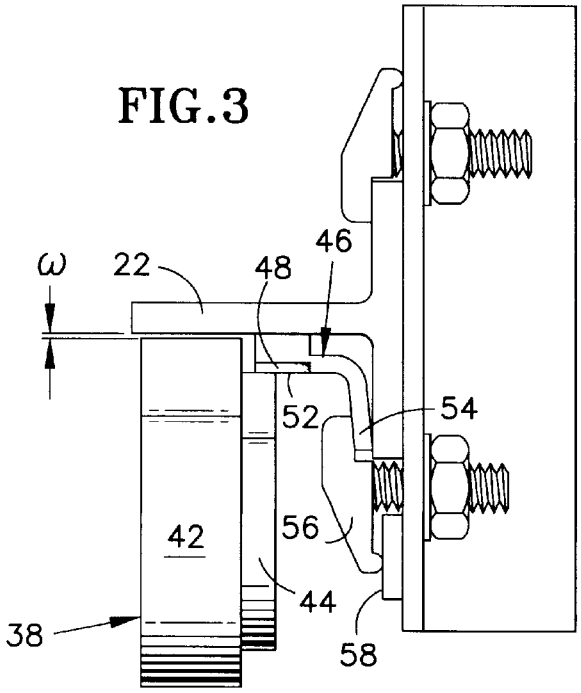
FIG. 3 is a top view of the guide roller engaged with the cam and illustrating a mounting arrangement for the cam.

Referring now to FIGS. 2 and 3, each of the lower rollers 38 includes a contact surface 42 that extends circumferentially about the roller 38 and a flange 44. The contact surface 42 is formed from a conventional elastomeric material to provide a smooth ride over the guide rails 22. The flange 44 extends outward from the roller 38 and is spaced radially inward from the contact surface 42. The flange 44 is formed from a less pliable material than the contact surface 42, such as steel or other metallic materials. The particular material selected for the flange 44 is selected based upon the need of the flange 44 to withstand the forces imposed on the roller 38 by the elevator car 14.

Each guide rail 22 includes a cam 46 disposed on one face of the guide rail 22. Each cam 46 is formed from steel or other suitable material and includes an inclined surface 48, a level surface 52, and a mounting arm 54. The cams 46 are located on the guide rails 22 to engage the flange 44 of the lower rollers 38 as the roller 38 moves adjacent to the cams 46. Relative to the landings within the hoistway 24, the cams 46 are disposed such that the lower rollers 38 engage the cams 46 when the car 14 is located at the lowest landing in the hoistway 24. This landing is then designated to be the parking position for the car 14 during extended periods of non-use.

The cams 46 are attached to the guide rails 22 by clamping the mounting arm 54 of the cam 46 between the guide rail 22 and a guide rail fastener 56. In order to ensure proper seating of the guide rail fastener 56, a spacer 58 is placed between the fastener 56 and the structure 58 to which the guide rail 22 is attached.

As the car 14 approaches the lowest landing, the contact surfaces 42 of the lower rollers 38 are in rolling contact with the faces of the guide rail 22. When the lowest rollers 38 move adjacent to the cams 46, the flanges 44 come into contact with the inclined surfaces 48 of the cams 46. Further movement of the car 14 causes the cams 46 to gradually lift the flanges 44 and rollers 38 away from the guide rails 22 such that a gap c) is created between the contact surface 42 of the lower rollers 38 and the face of the guide rails 22. Creation of the gap ω ensures that the loading on the rollers 38 is removed from the contact surface 42. Therefore, during extended periods of non-use, i.e., when the car 14 is parked at the lowest landing, there is no force on the elastomeric contact surface 42 of the rollers 38 and this surface 42 will not become deformed. Although shown as separating the contact surface from the guide rail to create a gap ω to eliminate forces on the contact surface 42, it should be understood that the flange 44 and cam 46 engagement may also be used to minimize the forces on the contact surface 42 to a level below which no deformation of the contact surface 42 takes place without the requirement of creating a gap between the contact surface 42 and the guide rail 22.

If the cams 46 are located at the lowest landing, the cams 46 are only engaged if the car 14 is stopping at the lowest landing. This ensures that the car 14 is moving at a slow speed during engagement of the flange 44 and the cam 46 and minimizes any vibration that is produced by the engagement. As an alternative, the cams may also be located at other landings within the hoistway. If they are located at the highest landing, however, the hydraulic cylinder would have to be maintained in the extended position when the car is parked. If the cams are located at an intermediate landing within the hoistway, the lower rollers would engage the cams each time the car passed the intermediate landing. At higher speeds, this may generate unwanted vibration in the car.

The invention has been shown and described as applied only to the lower rollers because these are the rollers for which the problem of deformation and the creation of 'flat' areas is greatest. It should be apparent, however, that similar rollers may be applied to the upper rollers, and additional cams may be placed on the opposite face of the guide rails to engage the upper rollers, to produce the same effect for these rollers.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator system having a car that moves within a hoistway and a guide rail disposed within the hoistway, wherein the car includes a roller that engages the guide rail to define the path of travel of the car through the hoistway, the roller including a contact surface and a flange, the contact surface engaging the guide rail in rolling contact such that a force is generated on the contact surface, the flange extending outward from the roller, the guide rail including a cam, the cam disposed to engage the flange upon sufficient motion of the car within the hoistway, wherein upon engagement between the flange and the cam the force on the contact surface is minimized.

2. The elevator system according to claim 1, wherein the cam includes a level surface and an adjacent inclined surface, wherein the flange initially engages the inclined surface.

3. The elevator system according to claim 2, wherein engagement between the level surface and the flange produces a gap between the contact surface and the guide rail.

4. The elevator system according to claim 1, wherein engagement between the cam and the flange produces a gap between the contact surface and the guide rail.

5. The elevator system according to claim 1, wherein the roller includes an elastomeric material that defines the contact surface.

6. The elevator system according to claim 5, wherein the flange is formed from a metallic material.

7. The elevator system according to claim 1, wherein the car is parked at a predetermined location during periods of non-use, and wherein the cam is disposed at a location on the guide rail such that the flange engages the cam when the car is parked.

8. The elevator system according to claim 7, wherein the cam includes a level surface and an adjacent inclined surface, wherein the flange engages the inclined surface as the car approaches the parking position and engages the level surface when the car is parked.

9. The elevator system according to claim 7, further including a plurality of landings disposed throughout the hoistway, wherein the parking location for the car is the lowest landing.

10. The elevator system according to claim 1, further including a second guide rail disposed within the hoistway and engaged with the car, the second guide rail including a second cam, wherein the car is suspended on the guide rails in a cantilevered arrangement and includes a pair of upper rollers and a pair of lower rollers, the pair of lower rollers including the first roller and a second roller, the second roller including a contact surface and a flange, the contact surface engaging the second guide rail in rolling contact such that a force is generated on the contact surface of the second roller, the flange extending outward from the second roller, the cam of the second guide rail disposed to engage the flange of the second roller upon sufficient motion of the car within the hoistway, such engagement minimizing the force on the contact surface of the second roller, and wherein the cams are positioned such that there is concurrent engagement between the pair of lower rollers and the cams.

11. A guide roller for an elevator system, the elevator system including a car and guide rail having a cam, the guide roller including a contact surface formed from an elastomeric material and a flange extending outward from the roller, the contact surface engaging the guide rail in rolling contact such that a force is generated on the contact surface, the flange engaging the cam upon sufficient motion of the car along the guide rail, wherein upon engagement between the flange and the cam the force on the contact surface is minimized.

12. The guide roller according to claim 11, wherein the flange is configured such that engagement between the flange and the cam produces a gap between the contact surface and the guide rail.

13. The guide roller according to claim 11, wherein the flange is formed from a metallic material.

14. A guide rail for an elevator system, the elevator system including a car that moves within a hoistway, wherein the car includes a roller that engages the guide rail to define the path of travel of the car through the hoistway, the roller including a contact surface and a flange, the contact surface engaging the guide rail in rolling contact such that a force is generated on the contact surface, the flange extending outward from the roller, the guide rail including a cam, the cam disposed to engage the flange upon sufficient motion of the car within the hoistway, wherein upon engagement between the flange and the cam the force on the contact surface is minimized.

15. The guide rail according to claim 14, wherein the cam includes a level surface and an adjacent inclined surface, wherein the inclined surface is positioned to initially engage the flange.

16. The guide rail according to claim 15, wherein engagement between the level surface and the flange produces a gap between the contact surface and the guide rail.

17. The guide rail according to claim 14, wherein engagement between the cam and the flange produces a gap between the contact surface and the guide rail.

18. The guide rail according to claim 14, wherein the car is parked at a predetermined location during periods of non-use, and wherein the cam is disposed at a location on the guide rail such that the cam engages the flange when the car is parked.

19. The guide rail according to claim 18, wherein the cam includes a level surface and an adjacent inclined surface, wherein the inclined surface engages the flange as the car approaches the parking position and the level surface engages the flange when the car is parked.

20. A method to minimize deformation of elevator guide rollers during periods of extended non-use of the elevator system, the elevator system including a car that moves within a hoistway and a guide rail disposed within the hoistway, the elevator system including a parked position for the car, the car including a roller that engages the guide rail to define the path of travel of the car through the hoistway, the roller including a contact surface and a flange, the contact surface engaging the guide rail in rolling contact such that a force is generated on the contact surface, the flange extending outward from the roller, the guide rail including a cam, the cam disposed to engage the flange upon sufficient motion of the car within the hoistway, the method including the steps of:

moving the car to the parked position; and engaging the flange with the cam such that the force on the contact surface is minimized.

21. The method according to claim 20, wherein the cam includes an inclined surface, and wherein the step of engaging the flange and the cam further includes the step of engaging the flange with the inclined surface such that the roller is gradually moved away from the guide rail.

22. The method according to claim 21, further including the step of separating the contact surface from the guide rail.

* * * * *